United States Patent [19]

Moughler

[11] 4,120,495

[45] Oct. 17, 1978

[54] BILLIARD HAND BRIDGE

[76] Inventor: Joseph R. Moughler, 85 Laurel Dr., Smithtown, N.Y. 11787

[21] Appl. No.: 672,985

[22] Filed: Apr. 2, 1976

[51] Int. Cl.[2] ..... A63D 15/00

[52] U.S. Cl. ..... 273/23

[58] Field of Search ..... 273/23, 24, 2, 14

[56] References Cited

U.S. PATENT DOCUMENTS

| | | | |
|---|---|---|---|
| 87,566 | 3/1869 | Hill | 273/23 |
| 211,416 | 1/1979 | McIntire | 273/23 |
| 239,931 | 4/1881 | Bullock | 273/23 |
| 855,684 | 6/1907 | Williamson | 273/23 |
| 898,345 | 9/1908 | Farnham | 273/23 |
| 968,187 | 8/1910 | McIntire | 273/23 |
| 1,105,478 | 7/1914 | Ames | 273/24 |
| 2,817,525 | 12/1957 | Niemann | 273/23 |
| 3,576,324 | 4/1971 | Lareau | 273/23 |

FOREIGN PATENT DOCUMENTS

| | | | |
|---|---|---|---|
| 3,112 | 2/1903 | United Kingdom | 273/23 |
| 309,768 | 4/1929 | United Kingdom | 273/23 |
| 326,459 | 3/1930 | United Kingdom | 273/23 |

*Primary Examiner*—Richard C. Pinkham
*Assistant Examiner*—T. Brown
*Attorney, Agent, or Firm*—Nolte & Nolte

[57] ABSTRACT

An apparatus for use in playing Billiards, Pocket Billiards, Snooker or Bumper Pool comprising one piece solid construction of wood or plastic with five different grooves. Said grooves provide a guide for the cut stick allowing for firm positioning and also allows the player to apply the desired "english" upon contact with the cue ball.

1 Claim, 4 Drawing Figures

BILLIARD HAND BRIDGE

SCALE 1:1

BILLIARD HAND BRIDGE

BRIEF SUMMARY

The Billiard Hand Bridge is constructed of wood or plastic (one piece solid construction) with five different options of use. It gives the Billiard Player lacking in manual dexterity the opportunity to play the game effectively.

DESCRIPTION OF VIEWS

Drawing # 1 shows side 1 and the bottom view with side 1 facing up.

Drawing # 2 shows side 2 and the bottom view with side 2 facing up.

Drawing # 3 shows the side view in an upright position.

Drawing # 4 shows an Isometric view (side 1) of the apparatus including the numbers for each groove.

DETAILED DESCRIPTION

Figure 1:
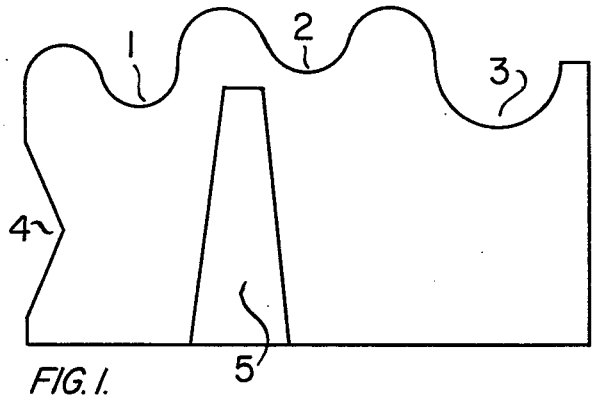
Figure 3:
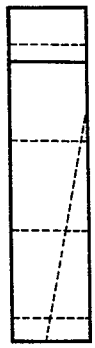
Figure 2:
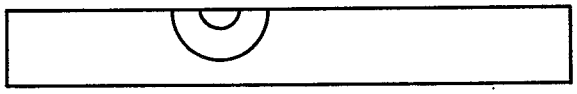
Figure 4:
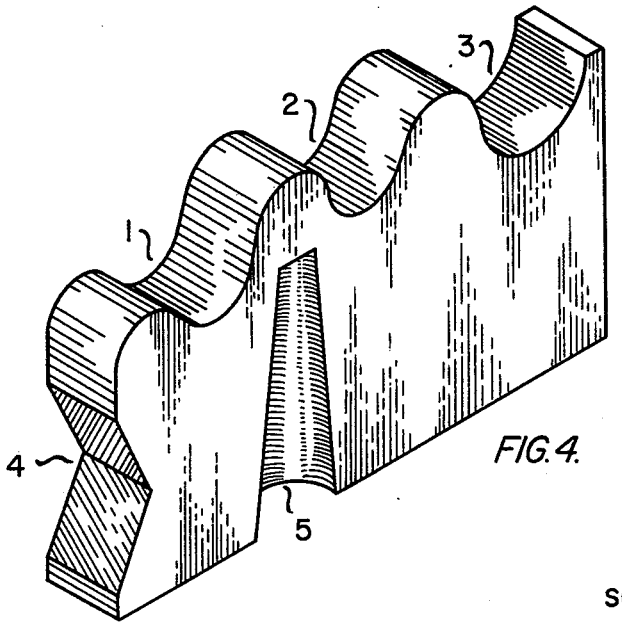

Size: 2 3/16 inch × 3¾ inch × ½ inch

Material: Wood or plastic

Finish: Spar Varnish (for wood construction only)

To Manufacture: Only simple woodworking tools are needed for wood construction. For plastic, an injection molding process is used.

USE OF APPARATUS

This apparatus is used by setting it down on the playing surface of a Billiard table behind the Cue Ball at any desired distance. The player then holds the apparatus between the thumb and forefinger of the left hand, if right-handed or between the thumb and forefinger of the right hand if left-handed. The player then places the narrow end of his Cue Stick in the desired groove of the apparatus, 1, 2, 3, 4, or 5.

Groove 1 is for hitting the cue ball dead center (no "english").

Groove 2 is for "Top English".

Groove 3 is for "Bottom English".

Groove 4 is used by placing the apparatus in a vertical position with groove 4 on the top. This position is used when there is a ball lying between the player and the cue ball. By using groove 4 in this position, the end of the cue stick is elevated and the player is enabled to shoot over the ball which is blocking the cue ball. Groove 5 is used when the cue ball is "frozen" against the cushion of the Billiard table by placing the apparatus flat down atop the cushion with side 1 facing up and the wide end of groove 5 facing the cue ball and by inserting the narrow end of the cue stick in groove 5 the player is enabled to make contact with the cue ball. In using Grooves 1, 2, 3 and 4, the apparatus may be used with either side facing the player. However, groove 5 can be used only as stated above.

I claim:

1. A billiard, pool or like cue guide comprising a body of generally flat, rectangular, slab-like form, having three sets of two opposite surfaces, a first set comprising first and second surfaces, a second set comprising third and fourth surfaces and a third set comprising fifth and sixth surfaces, each of said first, third and fifth surfaces having at last one cue guiding groove and said second, fourth, and sixth surfaces being constituted as means for supporting said body on a flat surface and being substantially mutually perpendicular, said first surface comprising a long side of said slab-like body and said second surface comprising an opposite long flat side of said body, said first surface having three cue guiding grooves, the spacing of bases of those grooves from said second surface each being different; said third surface comprising a relatively short side of said slab-like body having a single cue guiding groove therein and said fourth surface comprising an opposite short flat surface of said body; said sixth surface comprising a large flat surface and said fifth surface comprising an opposite surface having a single, relatively long, cue guiding groove formed therein, said last mentioned groove having a base inclined to the plane of said sixth surface and constituting means, when said sixth surface is disposed on a rail of a pool table, for guiding a cue in playing a ball close to said rail.

* * * * *